United States Patent [19]

Mazurkiewicz

[11] Patent Number: 5,035,362

[45] Date of Patent: Jul. 30, 1991

[54] DISINTEGRATION OF WOOD

[76] Inventor: Marian Mazurkiewicz, c/o The Curators of the University of Missouri, University Hall, Columbia, Mo. 65211

[21] Appl. No.: 152,893

[22] Filed: Feb. 5, 1988

Related U.S. Application Data

[63] Continuation of Ser. No. 822,481, Jan. 26, 1984, Pat. No. 4,723,715, which is a continuation of Ser. No. 615,384, May 30, 1984, abandoned.

[51] Int. Cl.[5] ..... B02C 19/18

[52] U.S. Cl. ..... 241/1; 144/208 D; 241/28; 241/301

[58] Field of Search ..... 144/208 D; 83/177, 53; 241/1, 5, 301, 28; 162/27, 20

[56] References Cited

U.S. PATENT DOCUMENTS

| | | | |
|---|---|---|---|
| 2,473,461 | 6/1949 | White | 144/208 D |
| 2,661,781 | 12/1953 | Simons | 144/208 D |
| 2,765,012 | 10/1956 | Riddell et al. | 144/200 D |
| 2,893,452 | 7/1959 | Shaw et al. | 144/208 |
| 3,326,607 | 6/1967 | Book | 83/53 X |
| 3,942,565 | 3/1976 | Ratelle et al. | 144/311 |
| 4,047,549 | 9/1977 | Ratelle et al. | 144/208 |

OTHER PUBLICATIONS

Adaptation of Jet Accumulation Techniques for Enhanced Rock Cutting, M. Mazurkiewicz, C. R. Barker, & D. A. Summers; ASTM-STP Publication No. 664, American Society for Testing and Materials, 1979, pp. 475–492.

"The Effect of Jet Traverse Velocity on the Cutting of Coal and Jet Structure" by D. A. Summers and M. Mazurkiewicz, May, 1976.

"The Enhancement of Cavitation Damage and its Use in Rock Disintegration" by M. Mazurkiewicz and D. A. Summers, Apr., 1982.

"Analysis of the Mechanism of Interation Between High-Pressure Water Jet and the Material Being Cut" by M. Mazurkiewicz, A. Sebastian and G. Galecki, Apr. 1978.

"Experimentation in Hydraulic Cool Mining" by David A. Summers, Clark R. Barker, and Marian Mazurkiewicz, Mar., 1977.

"The Further Development of a Cavitation Test Cell" by Dr. David A. Summers and Dr. Marian Mazurkiewicz Distributed at the Apr. 1981 Water Jet Symposium Sponsored by Colorado School of Mines.

"An Analysis of One Possibility for Pulsating a High Pressure Water Jet" by Dr. M. Mazurkiewicz Distributed at the May, 1983 2nd U.S. Water Jet Conference Sponsored by Rock Mechanics and Explosives Research Center School of Mines and Metallurgy University of Missouri-Rolla.

"The Effect of Jet Traverse Velocity on the Cutting of Coal and Jet Structure" by D. A. Summers and M. Mazurkiewicz, Distributed at the Third International Symposium on Jet Cutting Technology Held May 11–13, 1976 in Chicago, Illinois.

"The Enhancement of Cavitation Damage and Its Use in Rock Disintegration" by M. Mazurkiewicz and D. A. Summers Distributed at the 6th International Symposium on Jet Cutting Technology Held Apr. 6–8, 1982 at the University of Surrey, U. K.

"Analysis of the Mechanism of Interaction Between HIgh-Pressure Water Jet and the Material Being Cut" by M. Mazurkiewicz, Z. Sebastian and G. Galecki, Distributed at the Fourth International Symposium on Jet Cutting Technology Held Apr. 12–14, 1978 at the University of Kent in Canterbury, England.

"Experimentation in Hydraulic Cool Mining" by David A. Summers, Clark R. Barker, and Marian Mazukiewicz Distributed at the 1977 AIME Annual Meeting Held Mar. 6–10, 1977 in Atlanta, Georgia.

Peter Koch, Ph. D.; Wood Machining Processes; Feb. 7, 1968, Pub. 12,.75; p. 506.

James P. Casey; Pulp and Paper; vol. I; 1952 Edition; Pages 193 and 194.

*Primary Examiner*—Mark Rosenbaum

[57] ABSTRACT

Disintegration of a body of organic material involving subjecting the body to liquid jet action with the energy of the liquid as it impacts on the body such as to effect disintegration of the body into particles.

12 Claims, 6 Drawing Sheets

DISINTEGRATION OF WOOD

CROSS-REFERENCE TO RELATED APPLICATION

This is a continuation of application Ser. No. 822,481, filed 1-26-84, issued as U.S. Pat. No. 4,723,715, which is a continuation of Ser. No. 615,384, 5-30-84, now abandoned.

BACKGROUND OF THE INVENTION

This invention relates to the disintegration of organic material, and more particularly to methods of and apparatus for reducing a body of wood to a multiplicity of particles.

The invention is especially concerned with the disintegration of bodies of wood, and more particularly debarked logs, to produce wood particles for production of wood pulp for making paper.

Heretofore, generally standard practice for making wood pulp for paper production has involved the mechanical comminution of debarked logs, utilizing knives for chipping the logs, or grinding wheels or grindstones for grinding the logs. In either case, relatively high initial equipment cost and relatively high energy (power) consumption are involved, and the knives need sharpening and the grindstones need dressing, which is time-consuming and costly. Not only that, cutting and grinding may produce crushed fibers, which may be detrimental to the production of good quality pulp.

It is understood that much of the newsprint currently used is made from a mixture of 70% to 80% ground wood and the remainder unbleached sulphite or semi-bleached sulphate pulp. While ground wood pulp is of lower cost than chemical pulp, the cost of ground wood pulp is still relatively high because the grinding operation involves relatively high power consumption. Use of ground wood pulp may also have the disadvantage that paper containing a high percentage of ground wood is adversely affected as to color and strength qualities by exposure to sunlight, heat and air, and, is therefore less desirable for use in making newsprint, which must be capable of being fed through modern high speed presses without web breakage, and also capable of accepting inks with good printability.

With regard to energy consumption involved in grinding wood, energy is usually expressed in terms of horsepower/tons per day of air-dried pulp produced, i.e. horsepower input divided by the tons of pulp produced per day. The energy supplied to the grindstone is consumed in overcoming the friction between the stone and the surface of the wood being ground, and it is believed that almost all of it is transmitted to sensible heat in the water which is sprayed on the stone, and that only a small amount of the energy is absorbed in forming new surfaces as particles (fibers) separate from the wood. For example, in "Wood Machining Processes", by Peter Koch, published by Ronald Press Company, New York, N.Y. 1964, the average power requirement to yield ninety to ninety-five percent fiber from the original log volume is stated as 65 to 75 horsepower per day per ton (on an oven dry basis). According to "Pulp and Paper", by James P. Casey, published by InterScience Publisher, Inc., New York, N.Y. 1952, at a grinding pressure of 20 psi, the power consumption for a number of species of wood is as follows:

| | |
|---|---|
| Spruce | 70 hp/day/ton |
| Hemlock | 108 hp/day/ton |
| Jack Pine | 105 hp/day/ton |
| Shortleaf Pine | 125 hp/day/ton |
| Poplar | 140 hp/day/ton |
| Cottonwood | 215 hp/day/ton |

SUMMARY OF THE INVENTION

Among the several objects of the invention may be noted the provision of improved methods of and apparatus for more economically reducing a body of organic material, and more particularly a wood log, to particles especially for making wood pulp, although possibly useful for producing particles for other purposes; the provision of such methods and apparatus which may attain improved economy by reduction of initial equipment cost, reduction of power consumption, and elimination of sharpening and dressing; and the provision of such methods and apparatus which, in addition to the stated economic advantage, produce particles, and especially wood fibers, of requisite quality for making good quality pulp for good quality paper production.

In general, the method of this invention involves the disintegration of a body of organic material by liquid jet action, and the apparatus comprises means for carrying this out, as will be described.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
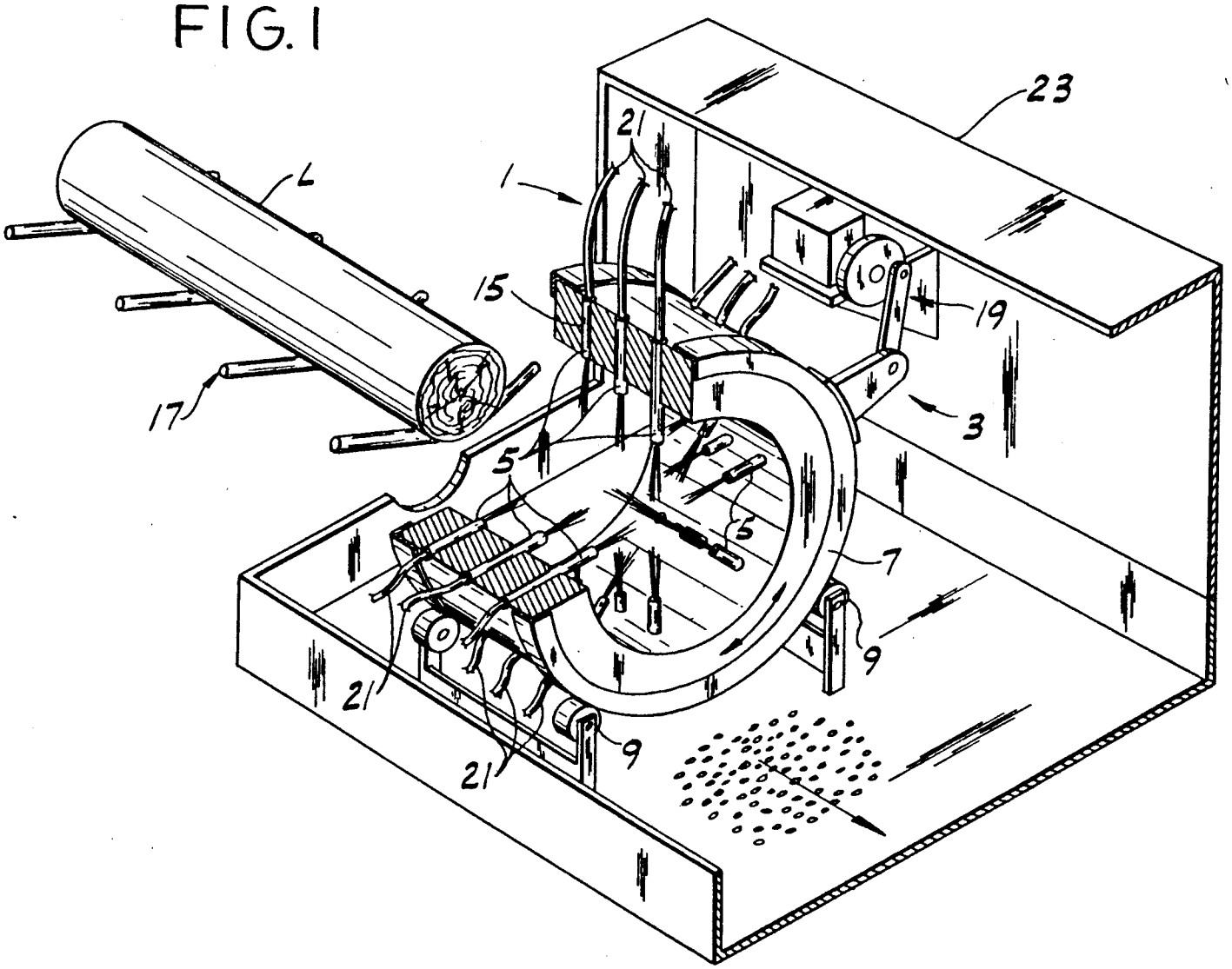
FIG. 1 is a perspective, with parts broken away and shown in section, of a first embodiment of apparatus of this invention.
Figure 6:
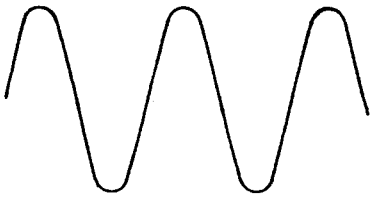
FIG. 6 is a view illustrating the trajectory on a log of a jet from a nozzle of the first embodiment as the log is fed past the nozzle at a relatively fast speed.
Figure 7:
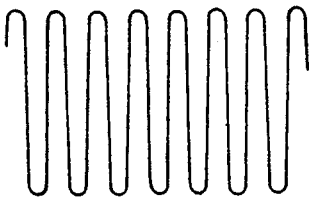
FIG. 7 is a view illustrating the trajectory on a log of a jet from a nozzle of the first embodiment as the log is fed past the nozzle at a relatively slow speed.

Referring to FIG. 1 of the drawings, a first embodiment of apparatus of this invention for carrying out the method of this invention is shown basically to comprise means generally indicated at 1 for subjecting a body of organic material such as wood, which is to be reduced to a multiplicity of particles, to liquid jet action with the energy of the liquid as it impacts on the body such as to effect disintegration of the body into particles. Generally the liquid is water, although for wood pulping it may be a chemical pulping liquid. The water may be at ambient temperature, or may be heated for wood pulping. Thus, it may be at a temperature in the range from about 20° C. to about 180° C. The apparatus has means as will appear, generally indicated at 3, for effecting relative movement between the body of wood and the liquid such that the liquid impacts on the body in a trajectory having a longitudinal and a transverse component relative to the body. Typical trajectories are illustrated in FIGS. 6 and 7. The apparatus is adapted for reducing a log L, more particularly an already debarked log, to a multiplicity of particles wherein the means 1 for subjecting the log to liquid jet action comprises a plurality of nozzles, each designated 5, for directing jets radially inwardly on the log. The jets are preferably coherent jets, but it is contemplated that they may be fan, cavitated or pulsed jets. The means 3 for effecting the stated relative movement between the log and the nozzles effects this movement endwise and circumferentially of the log so that each jet impacts on the log in the stated trajectory having a longitudinal and girthwise component relative to the log.

Figure 2:
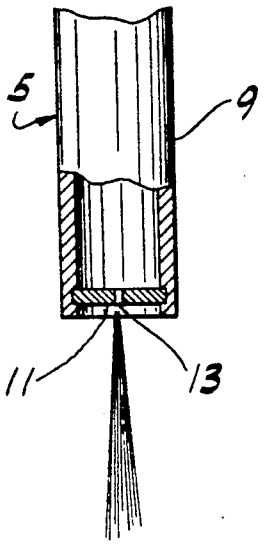
FIG. 2 is a detail, partly in section, showing the tip of a nozzle of the FIG. 1 embodiment.

More particularly, the FIG. 1 apparatus, as shown, comprises nozzle-holding means 7 in the form of an annular open-ended drum or cylinder suitably mounted as indicated at 9 for oscillation on its axis, which may be more or less horizontal, and preferably slightly inclined from one end of the drum, constituting the entrance end for a log, which is its left end as illustrated in FIG. 1, to its other (right) end. The nozzles 5 are mounted in the cylindrical wall of the drum extending generally radially thereof, each nozzle generally comprising a tubular body 9 with a nozzle orifice member or tip 11 at its inner end (see FIG. 2). In the tip is the nozzle orifice 13. Brass, sapphire and carbide tips have been used in preliminary tests. The nozzles may be mounted in the wall of the drum for radial adjustment in and out relative to the drum, being slidably adjustable in radial openings 15 in the wall, for example. As appears in FIG. 1, the nozzles may be arranged in a number of circular series spaced lengthwise of the drum, with the nozzles extending progressively farther inward in the successive circular series 15 to take into account the progressive disintegration of the log as it is fed forward. Three such series are shown, the nozzles also being arranged in rows extending lengthwise of the drum.

At 17 is indicated a roller conveyor for supporting a log L in position for feeding the log endwise through the drum 7 from the entrance (left) end of the drum, enabling movement of the log as by manually pushing it endwise through the drum for impact of jets of liquid from the nozzles 5 on the log as it passes through the drum. Obviously, the endwise feed of the log may be a suitably powered feed, as by use of a hydraulic pusher means or a chain puller means. At 19 is generally indicated means for effecting oscillation of the drum (and hence the nozzles) through a selected arc and at a selected rate so that each jet of liquid impacts on the log in the stated trajectory having a longitudinal component and a transverse or girthwise component relative to the log. The nozzles are supplied with liquid under relatively high pressure via flexible high-pressure supply lines as indicated at 21 supplied with the liquid from a high-pressure pump (not shown). The flexible supply lines permit the oscillation of drum and the nozzles.

In the operation of the apparatus, a debarked log is fed through the drum generally at a predetermined rate. As the log is fed through the drum, it is subjected to the liquid jet action of the jets of liquid directed radially inwardly on the log all around the log by the oscillating nozzles 5. The oscillation of the drum through an arc in conjunction with the axial feed of the log causes each jet to impact on the log in a trajectory having the desired longitudinal and girthwise trajectory relative to the log. Liquid is delivered from the nozzles 5 at such high pressure that the energy of the liquid as it impacts on the log is such as to effect disintegration of the log into particles. The pressure (hence the energy) and the trajectory may be controlled for control over the characteristics of the particles, as will be described later. Generally, the log is completely disintegrated into particles by the jets, although it is intended that less than complete disintegration is within the scope of the invention. It will be observed that the inward stepping of the nozzles from the first to the third circular series of nozzles may be such that the standoff distance of the nozzle tips from the log passing through the drum is about the same for the successive series. The drum 7 with its nozzles 5 is housed in a suitable shroud or housing such as indicated at 23 for collection of particles from the disintegration of the log and carrying the particles away by the liquid which effected the disintegration.

FIGS. 6 and 7 illustrates the jet trajectories obtained by feeding logs through the drum at different rates. In each case, the trajectory (i.e., the path of the jet where it impacts on the log) is generally sinusoidal on the curved surface of the log, extending lengthwise of the log, with the amplitude (representing the transverse component of the wave form) corresponding to the arc of oscillation of the jet and the pitch (frequency) determined by the log speed. FIG. 6 illustrates the wave form for a relatively fast moving log and FIG. 7 the wave form for a relatively slow moving log. Generally, the particle size is directly proportional to the log speed, the faster the speed (FIG. 6) the larger the particles, and vice versa (FIG. 7). It will be understood that the number and arrangement of nozzles is such that the jet trajectories generally cover the entire surface of the log for complete disintegration of the log.

For the requisite energy of the liquid (e.g. water) as it impacts on the log to effect disintegration of the log into particles, the jet diameter (nozzle orifice diameter) may range from about 0.1 mm to about 5.0 mm and the liquid pressure as supplied to the nozzles should be above about 4,000 psi. For disintegration of the log into chips, the nozzle orifice diameter may be about 0.4 mm and the pressure about 20,000 psi. For disintegration of the log into fibers, the nozzle orifice diameter may be about 0.6 mm and the pressure about 10,000 psi. For disintegration of the log into powder, the nozzle orifice may be about 1.0 mm and the pressure about 60,000 psi.

Figure 3:
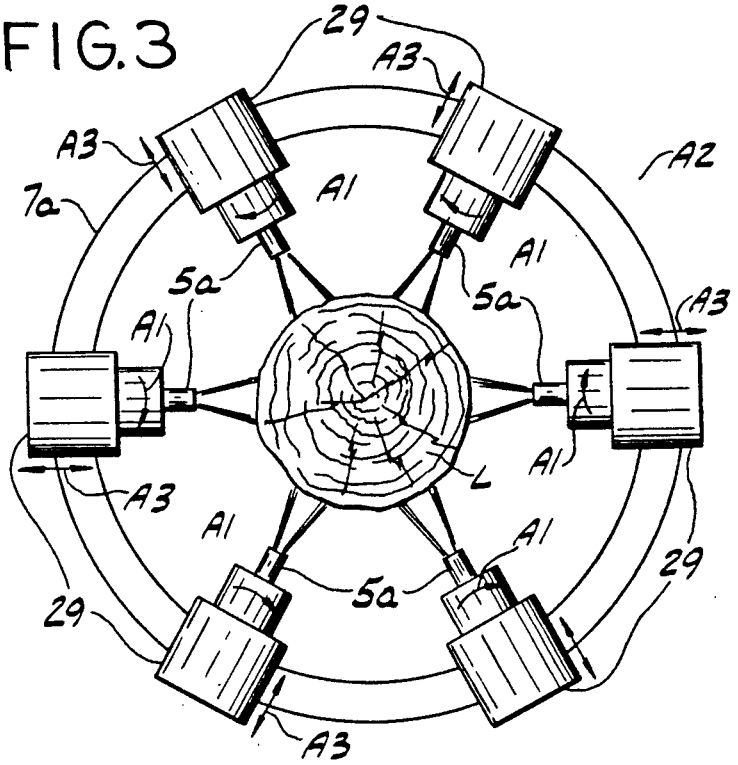
FIG. 3 is a view illustrating a second embodiment of the apparatus.
Figure 4:
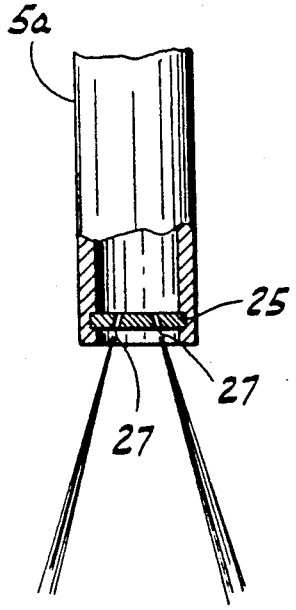
FIG. 4 is a detail, partly in section, showing the tip of a nozzle of the FIG. 3 embodiment, the nozzle here being a rotary dual-orifice nozzle.

FIG. 3 illustrates a second embodiment of the invention generally corresponding to the FIG. 1 embodiment with the principal difference that each nozzle, here designated 5*a*, is a multi-orifice nozzle and is rotated around an axis extending generally radially with respect to the log. The rotation of the nozzles is indicated by the arrows A1. FIG. 4 illustrates a dual-jet nozzle 5*a*, having a tip 25 with two orifices each designated 27 therein, these orifices being angled at 15°, for example, to the nozzle axis so that they diverge at an angle of 30° toward the exit. The nozzles may be mounted in a drum 7*a* similar to the drum 7 shown in FIG. 1, the drum 7*a* being oscillable like drum 7 as indicated by the arrow A2, and the nozzles being adjustable in and out as indicated by the arrow A3. Each nozzle may be rotated by suitable drive means such as indicated at 29 in FIG. 3.

Figure 8:
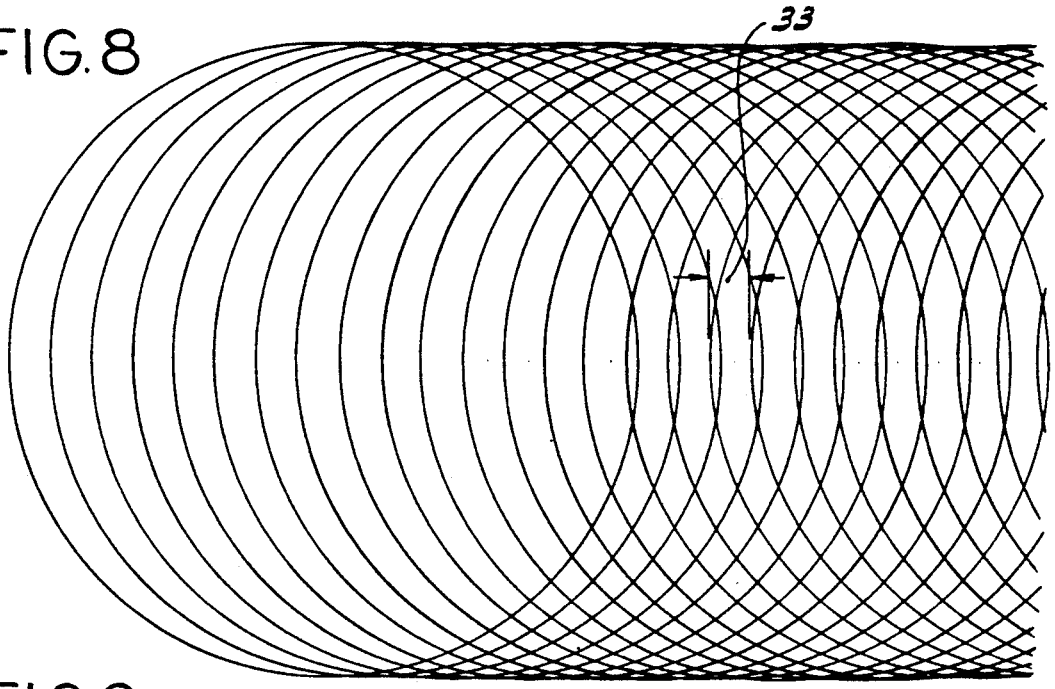
FIG. 8 is a view illustrating the trajectory on a log of a jet from a rotary nozzle of the FIG. 3 embodiment as the log is fed past the nozzle at relatively slow speed and the nozzle is rotated at relatively slow speed.
Figure 9:
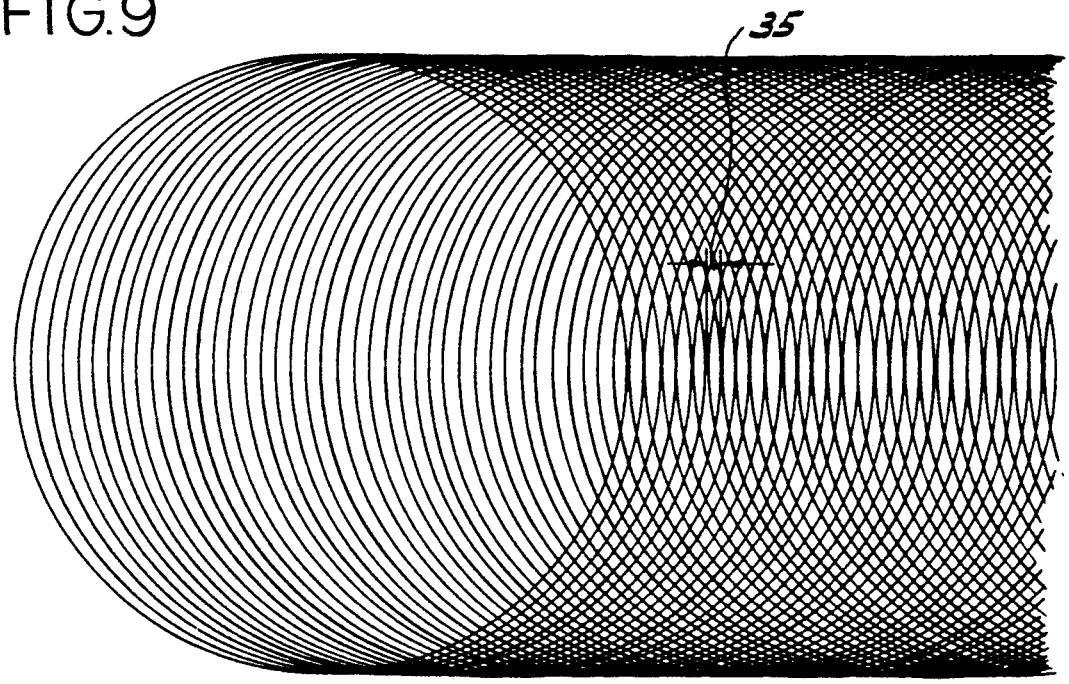
FIG. 9 is a view illustrating the trajectory on a log of jets from a rotary nozzle of the FIG. 3 embodiment as the log is fed past the nozzle at relatively fast speed and the nozzle is rotated at relatively fast speed.
Figure 10:
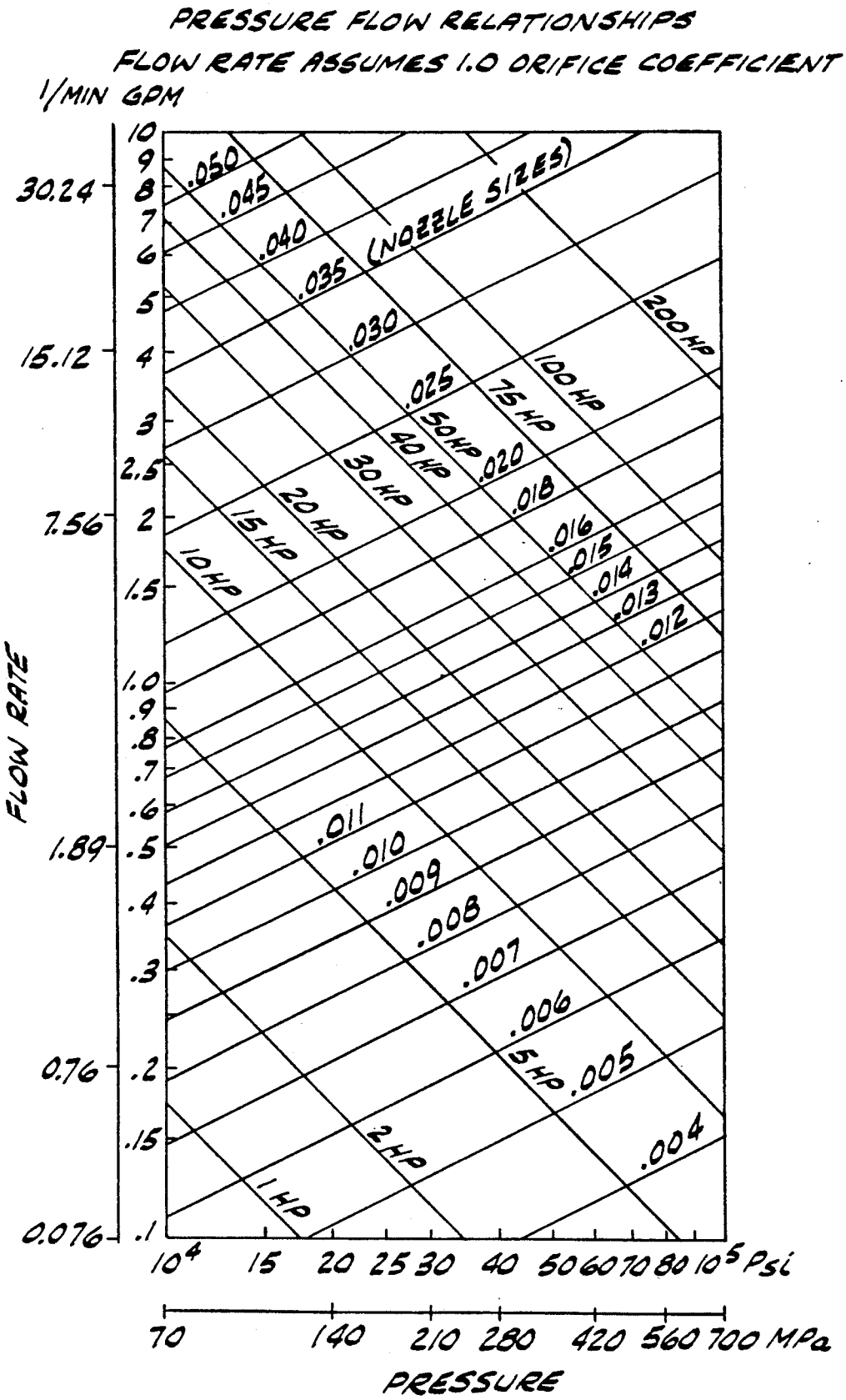
FIG. 10 is a chart showing flow rate/pressure relationships for nozzle orifices of different sizes, the nozzle orifice size being expressed in inches, also showing the horsepower requirements.

FIGS. 8 and 9 illustrated (enlarged), a small span of the jet trajectories obtained by feeding a log past a rotary nozzle, the latter rotating at different rates. In each case, the trajectory is generally cycloidal on the curved surface of the log, extending lengthwise sinusoidally of the log. FIG. 8 illustrates a small part of the cycloidal trajectory for a relatively slow moving log and relatively slow nozzle rotation rate (e.g. 10 inches per minute log speed and 60 rpm nozzle rotation rate) and FIG. 9 illustrates a small part of the cycloidal trajectory for a relatively fast moving log and relatively high nozzle rotation rate (e.g. 15 inches per minute log speed and 220 rpm nozzle rotation rate). The particle lengths derived by these trajectories are indicated at 33 and 35 in FIGS. 8 and 9. Generally, it may be said that the length of the particles is in direct relationship to the log feed and in inverse relationship to the nozzle speed. In the case of a log fed through drum 7*a*, which is oscillating, the trajectories would be cycloidal and sinusoidal.

Figure 5:
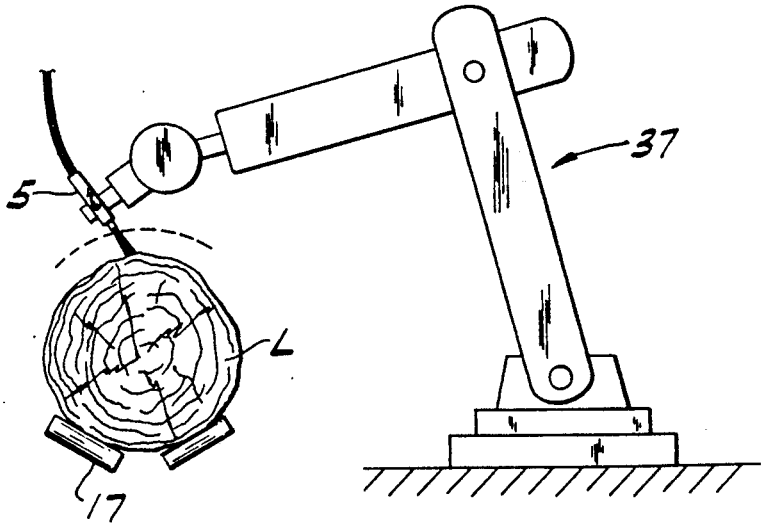
FIG. 5 is a view illustrating a third embodiment of the apparatus.

FIG. 5 illustrates a third embodiment of the invention comprising a nozzle 5 operable by a robotic apparatus 37 in cooperation with the feed of the log L on conveyor 17 past the nozzle to generate the desired jet trajectory.

It is to be noted that the liquid jet is generated by a potential energy build-up prior to the liquid exiting the nozzles. The nozzle transforms this energy into kinetic energy. According to the Bernoulli equations, the jet velocity becomes:

$$v = \sqrt{\frac{2P}{\rho}}$$

where:

v=jet velocity p=pressure $\rho$=liquid density.

The flow rate of the jet stream equates to the cross-sectional area of stream multiplied by this stream velocity. The cross-sectional area of the jet is related to the nozzle orifice cross-section area and the discharge coefficient, which depends on the nozzle geometry and the quality of manufacture.

The power required to produce the flow is given by the equation:

$$W = C_d \cdot \frac{\pi D^2}{4} \cdot \sqrt{\frac{2}{\rho}} \cdot p^{3/2}$$

In this equation:

$C_d$=nozzle discharge coefficient

D=nozzle orifice diameter $\rho$=fluid density p=generating pressure.

The impact of the jet on the body of wood separates wood particles from the body, the separating action generally increasing with the energy impact per unit length of impact, and depending on the jet pressure, diameter, standoff distance of the nozzle from the work and the feed rate velocity. Generally the separating ability increases with the energy input per unit length of cut.

The standoff distance is believed to be an important factor in the process. With a relatively small distance between the nozzle and the work the jet has a good action. At greater distances, the jet action is adversely affected.

When the motion of a regular coherent jet is abruptly stopped by a solid body, a very high pressure is created around the contact area. This approximates the water hammer pressure at the instant of impact and then decays to the hydrodynamic stagnation pressure, which for incompressible flow is given by:

$$P_{st} = \frac{1}{2} \rho \cdot v^2$$

where:

$\rho$=the density of incompressible flow v=the normal component of the collision velocity.

During this impact a high velocity lateral flow is created. The velocity of this flow is several times larger than that of the inlet flow and is highly destructive to structural material such as wood.

Because of the strong wood anisotropy, it is difficult to develop, from a theoretical aspect, the relationship between water jet parameters and particle separation ability. To obtain these, certain experiments were carried out, specifically in two groups: first with a rotary nozzle moved along the work with the work stationary, and second with a non-rotary nozzle moved along the work being turned in a lathe.

The cycloid nozzle experiment utilized a water jet nozzle having two closely spaced 1 mm diameter (0.04 in.) nozzle orifices with an included angle of 30° and were carried out on a test rig in which the nozzle was traversed along the work. The feed rate of the nozzle along the work was varied at levels of 30.48 cm/min (1 ft/min), 91.5 cm/min (3 ft/min), 152.2 cm/min (5 ft/min), and 304.8 cm/min (10 ft/min). The nozzle was rotated at a constant speed of 120 rpm. The experiment was carried out at pressures of 35 MPa (5000 psi), 70 MPa (10,000 psi), and 105 MPa (15,000 psi), and at standoff distances of 1.27 cm (0.5 in.) and 15.24 cm (6 in.) from the work. As a sample, a dried red oak log was used measuring 30.48 cm×30.48 cm×244 cm (12 in.×12 in.×8 ft.). The trajectory developed by the jets on the sample log are simple cycloids similar to those shown in FIGS. 8 and 9. The parametric equations of these curves are:

$$x_i = v_L \cdot t + r \cos \omega t$$

$$Y_i = r \sin \omega t$$

where:

r = radius of circle of impact $v_L$ = feed rate t = time.

The size of the particles will be governed by the linear feed rate and the nozzle rotational speed, and can be further controlled by adding nozzles to the system. Thus, practically any wood particle length can be achieved by adjusting the relationship between the feed rate and the nozzle rpm. These two parameters and the jet radius control the velocity of the point of jet impact which can be found from the equation:

$$v_c = v_L^2 + \omega 2_r - 2\omega \cdot r \cdot v_L \cdot \sin\omega t$$

where:

$v_L$ = feed rate r = radius of circle of impact $\omega$ = angular nozzle velocity t = time.

Figure 11:
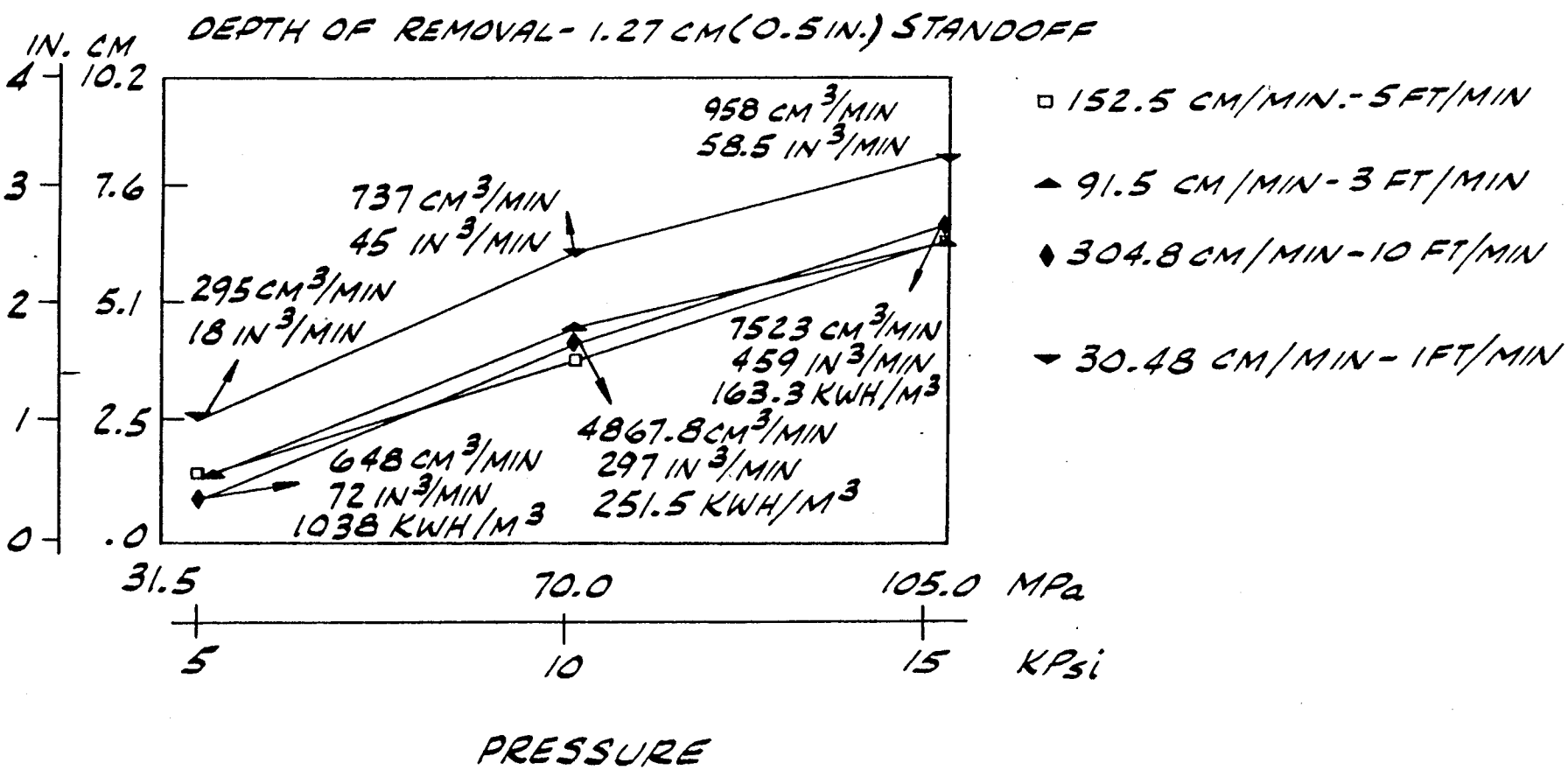
FIG. 11 is a chart showing depth of removal/pressure relationships on a test in which a rotary nozzle was moved along the work 1.27 cm (0.5 in) from the work.
Figure 12:
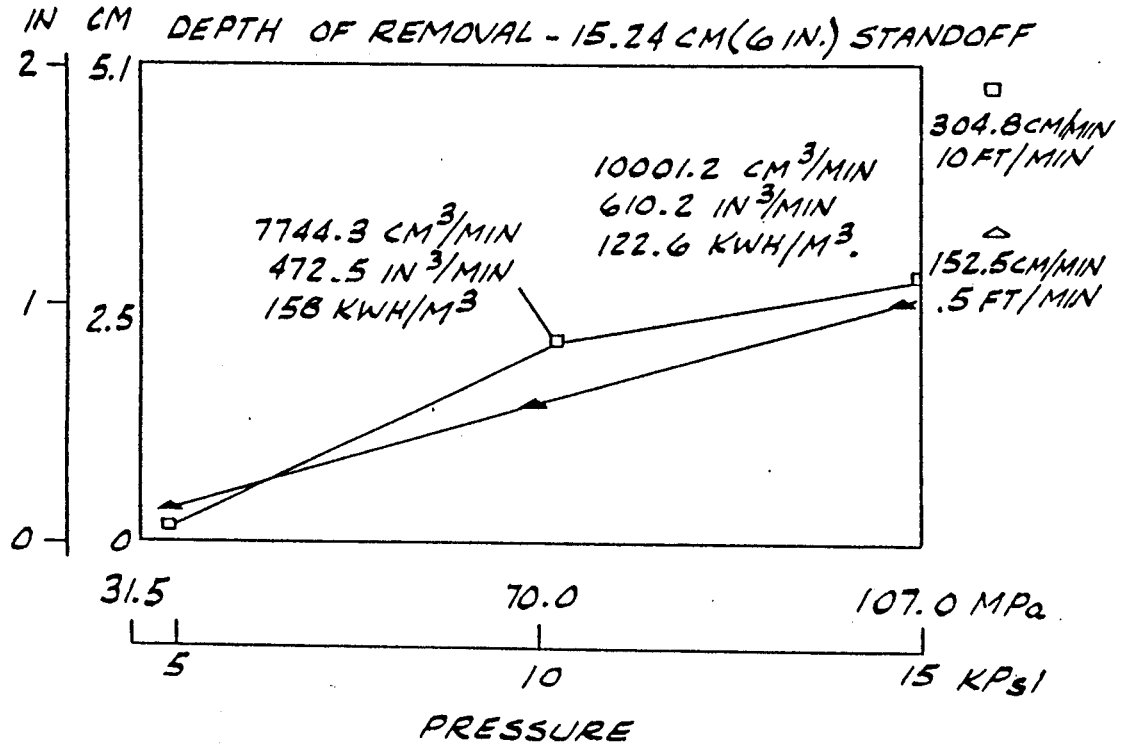
FIG. 12 is a chart showing depth of removal/pressure relationships on a test in which a rotary nozzle was moved along the work 15.24 cm (6 in) from the work.

Following the tests carried out, as described earlier, the particles were collected and the depth of particle removal was measured. This data was used to develop the relationship between the depth of particle removal, the jet pressure and the different feed rates and standoff distances. Such plots are shown in FIGS. 11 and 12 with remarks concerning the volume of wood removed and the specific energy involved. FIGS. 11 and 12 confirmed the theoretical expectations. The depth of particle removal increases with jet pressure and decreases with feed rate. The relationship between said depth and feed rate is not as yet completely clear, however.

Over the range of feed rates examined to data, as the $V_c$ equation demonstrates, the jet traverse velocity is controlled by the work feed rate and the jet radius. Thus, increasing the radius of the circle of impact from 1.9 cm (0.75 in.) to 12.7 cm (5 in.) and 25.4 cm (10 in.) will increase jet traverse velocity at a feed rate of 304.8 cm/min (10 ft/min) at 120 rpm from about 304.0 cm/min (120 in/min) to 309.9 cm/min (122 in/min) then to 439.4 cm/min (173 in/min).

Then if the experiment is carried out for example, at a radius of the circle of impact of 10 cm (4 in) the depth of particle removal should be in the same range. This means that the power consumption will drop significantly from 163.3 KWh per 1 $m^3$ of solid red oak pulped to around 16.3 KWh per 1 $m^3$ of pulp produced.

Figure 13:
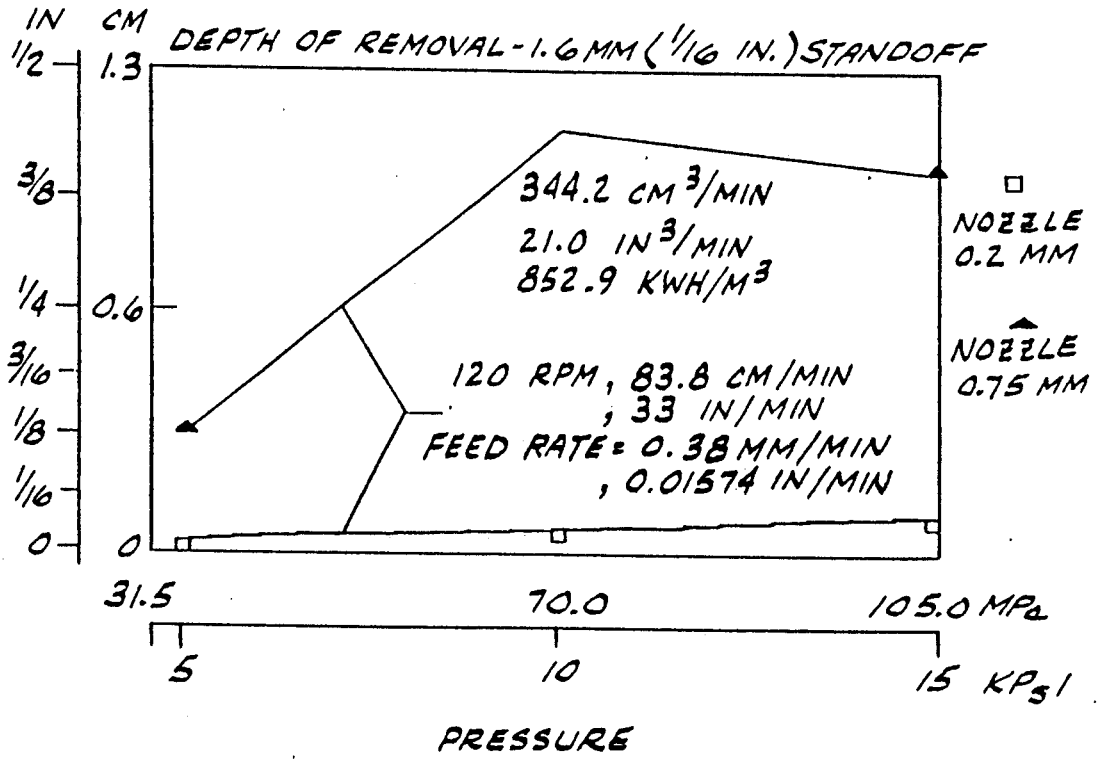
FIG. 13 is a chart showing depth of removal/pressure relationships on a test in which the work was turned in a lathe and a non-rotary nozzle was moved along the work.

The second test was carried out on a lathe rotating at 120 rpm using a dried red oak cylindrical sample measuring 13.3 diameter × 43.2 cm (5¼ diameter × 17 in) at a feed rate of 0.38 mm/min (0.01574 in/min). A nozzle with a 0.2 mm (0.008 in) orifice and a nozzle with a 0.75 mm (0.030 in) orifice were used. The standoff distance was 1.6 mm (1/16 in). The tests were run at jet pressures of 35 MPa (5,000 psi) 70 MPa (10,000 psi) and 105 MPa (15,000 psi). The results of these tests are presented in FIG. 13.

The quality of the fibers removed as a product of the operation are an important feature of the pulping process, and are the measure of the success of the operation. The degree of damage to the fiber walls is especially important in the case of hardwood cutting. For this reason a series of scanning microscope photographs were taken of the material produced in the tests. Upon careful study of the photographs, it appeared that smashed fibers occured only rarely. It also appeared that the fibers were very effectively separated, by the jet, without noticeable damage.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. The method of reducing a body of organic material having longitudinal and transverse dimensions to a multiplicity of organic particles, said method comprising subjecting the body to liquid jet means comprising at least one substantially coherent continuous stream of liquid at a delivery pressure of from about 4,000 psi to about 60,000 psi, and effecting relative movement of said jet means and the body so that the liquid as it impacts on the body traverses a path on the body at a relatively low velocity of less than about fifteen feet per minute whereby the energy of the liquid as it impacts on the body is sufficiently concentrated and of sufficient duration to effect disintegration of the body into said multiplicity of particles, said traversal path followed by the impacting liquid comprising a plurality of closely spaced reaches disposed over at least a substantial portion of the outer surface of the body whereby the body is substantially completely disintegrated over a relatively large area extending both longitudinally and traversely with respect to the body.

2. The method of claim 1 wherein relative movement is effected between the body and the liquid such that the liquid impacts on the body in a trajectory having a longitudinal component and a transverse component relative to the body.

3. The method of claim 2 wherein the trajectory is sinusoidal.

4. The method of claim 2 wherein the trajectory is cycloidal.

5. The method of claim 1 wherein said body has a length and a girth, said method comprising subjecting the body to a plurality of liquid jets directed generally radially inwardly on the body.

6. The method of claim 5 wherein relative movement is effected between the body and the jets endwise and girthwise of the body so that each jet impacts on the body in a trajectory having a longitudinal and a girthwise component relative to the body.

7. The method of claim 6 wherein the jets are oscillated in a generally fixed plane normal to the body as the body moves endwise past the jets.

8. The method of claim 6 wherein each jet is rotated around an axis extending generally radially with respect to the body.

9. The method of claim 8 utilizing multi-orifice nozzles and wherein each nozzle is rotated around an axis extending generally radially with respect to the body.

10. The method of claim 1 wherein each jet is delivered through an orifice having a diameter from about 0.1 mm to about 5 mm.

11. The method of reducing a body of organic material having a length and girth to a multiplicity of organic particles, comprising feeding the body forward in the direction of its length at a relatively low velocity of less than about fifteen feet per minute, and, as it is fed forward, subjecting it to the action of a plurality of jets of liquid directed generally radially inwardly on the body all around the body, each jet comprising a substantially coherent continuous stream of liquid wherein the delivery pressure of the liquid is from about 4000 psi to about 60,000 psi and wherein each jet is delivered through an orifice having a diameter of from about 0.1 mm. to about 5 mm., the energy of the liquid as it impacts on the body thus being sufficiently concentrated and of sufficient duration as to effect substantially complete disintegration of the body into said particles over a relatively large area extending both girthwise and lengthwise with respect to the body.

12. The method of claim 11 wherein the jets are oscillated in a generally fixed plane normal to the body as the body moves endwise past the jets, and wherein each jet is rotated around an axis extending generally radially with respect to the body.

* * * * *